US010297361B2

(12) United States Patent
Sevier

(10) Patent No.: US 10,297,361 B2
(45) Date of Patent: May 21, 2019

(54) SELF-BONDING CONDUCTIVE WIRE

(71) Applicant: Rubadue Wire Co., Inc., Greeley, CO (US)

(72) Inventor: David Sevier, Greeley, CO (US)

(73) Assignee: Rubadue Wire Co., Inc., Loveland, CO (US)

( * ) Notice: Subject to any disclaimer, the term of this patent is extended or adjusted under 35 U.S.C. 154(b) by 1206 days.

(21) Appl. No.: 14/044,520

(22) Filed: Oct. 2, 2013

(65) Prior Publication Data

US 2015/0093573 A1 Apr. 2, 2015

(51) Int. Cl.

| | |
|---|---|
| ***H01B 3/42*** | (2006.01) |
| ***H01B 7/02*** | (2006.01) |
| ***H01B 13/00*** | (2006.01) |
| ***H01B 13/14*** | (2006.01) |
| ***H01F 27/32*** | (2006.01) |

(52) U.S. Cl.

CPC ..... *H01B 3/421* (2013.01); *H01B 3/427* (2013.01); *H01B 13/0023* (2013.01); *H01B 13/145* (2013.01); *H01B 7/0275* (2013.01); *H01F 27/32* (2013.01); *Y10T 156/1007* (2015.01); *Y10T 428/2933* (2015.01)

(58) Field of Classification Search

USPC ..... 428/375, 383, 379; 156/199, 244.12

See application file for complete search history.

(56) References Cited

U.S. PATENT DOCUMENTS 4,945,191 A * 7/1990 Satsuka ..... H01B 3/421 174/120 SR

2006/0102380 A1* 5/2006 Hu ..... H01B 3/445 174/120 R

2012/0308819 A1* 12/2012 Ni ..... C08K 3/22 428/383

FOREIGN PATENT DOCUMENTS

GB 1513036 * 6/1978 ..... H01B 3/30

OTHER PUBLICATIONS

Dupont Hytrel 3078—Thermoplastic Polyester Elastomer; Product Information; 2001; 4 Pages; Dupont Company; plastic.dupont.com.

Dupont Tefzel 207—Floropolymer Resin; Product Information; Aug. 2002; 2 Pages; Dupont Fluoroproducts; www.teflon.com.

Triple Insulated Wire-Self Bonding Type TEX-ECEW3 (Insulated Winding Wires); 2 Pages; The Furukawa Electric Co., Ltd; 2004; www.furukawa.co.jp/makisen/eng/product/texecew3.htm.

(Continued)

*Primary Examiner* — Lynda Salvatore

(74) *Attorney, Agent, or Firm* — Stetina Brunda Garred and Brucker

(57) ABSTRACT

A self-bonding conductive wire and methods in which it is made and used. The wire comprises a conductor, an insulator, and a self-bonding outer coating. The self-bonding outer coating is a polyester polyether block copolymer. The insulator is an ethylene/tetrafluoroethylene copolymer, one or more layers of which may be used to insulate the conductor. The self-bonding capabilities of the wire may be activated by heating the wire, causing the outer coating to thermoplastically deform and fuse, allowing for the creation of self-supporting structures such as large bobbin-less coils. The use of the polyester polyether block copolymer for the self-bonding outer coating is superior to other materials, in which significant degradation of qualitative properties following self-bonding is observed, resulting in a superior self-bonding conductive wire.

10 Claims, 2 Drawing Sheets

(56) References Cited

OTHER PUBLICATIONS

Tomokazu Yasuda, Takuzo Aida, and Shonei Inoue; Synthesis of Polyester-Polyether Block Copolymer With Controlled Chain Length From B-Lactone and Expdxide by Aluminum Porphyrin Catalyst; Macromolecules, vol. 17, No. 11, 1984, pp. 2217-2222; American Chemical Society.

* cited by examiner

SELF-BONDING CONDUCTIVE WIRE

CROSS-REFERENCE TO RELATED APPLICATIONS

Not applicable

STATEMENT RE: FEDERALLY SPONSORED RESEARCH/DEVELOPMENT

Not applicable

BACKGROUND

1. Technical Field

The present disclosure relates generally to self-bonding conductive wire. More particularly, the present disclosure relates to the use of polyester polyether block copolymers in self-bonding wire, and methods of making and using such wire.

2. Related Art

In the use of conductive wire, it is common that wire may be placed into specific configurations as desired by a user, such as wrapping the wire into coils. Once the wire has been placed into a desired configuration, it becomes necessary to secure the wire in that configuration. This securing may maintain the integrity of the chosen wire configuration, and ensure that the individual wires do not become loose, noisy, or subject to early failure through vibrations and other movement. Securing wire is especially important when the wire is shaped into self-supporting or unusual configuration, such as bobbin-less coils.

Many conventional ways have been developed to secure wire. In the past, wire has been coated with a liquid or viscous varnish, which hardens following the coating step to maintain the wire's configuration. It was later found that wires may be made with outer coatings which may self-adhere or self-bond, eliminating the requirement for a varnishing step.

Various outer coatings have been used which may confer self-adhering or self-bonding properties to wire. Typically, self-bonding is achieved by softening or melting the coating and then allowing the coating to resolidify and fuse. The softening or melting may be performed by application of heat, electricity, or a suitable solvent. However, previously used outer coatings suffer from various deficiencies, such as sharp reductions in melting point, modulus, tensile strength, and elasticity following resolidification and fusion.

Consequently, there is a need for an improved self-bonding conductive wire.

BRIEF SUMMARY

To solve these and other problems, it is contemplated that a polyester polyether block copolymer material may be used to form a self-bonding coating over a conductive wire, in order to confer superior self-bonding properties to that wire. Particularly, it is contemplated that the polyester polyether block copolymer material may have a durometer hardness (Type D) measured according to ISO 868 of about 30. Such material may be made by known methods of synthesis, or may be obtained commercially from manufacturers such as E.I. DuPont de Nemours and Co., Inc.

The self-bonding conductive wire may comprise a conductor and a covering disposed over the conductor formed of a polyester polyether block copolymer. The polyester polyether block copolymer may have a durometer hardness (Type D) measured according to ISO 868 of about 30.

The conductive wire may also have an insulator disposed between the conductor and the covering. The insulator may comprise one or more layers of insulation disposed between the conductor and the covering. The one or more layers of insulation may be a fluoropolymer. The fluropolymer may be an ethylene/tetrafluoroethylene copolymer.

Such a conductive wire may be made by disposing an insulator over a conductor, and applying a covering over the insulator comprising a polyester polyether block copolymer. The steps of applying the insulation material and the polyester polyether block copolymer covering may be accomplished by extrusion through an extrusion crosshead.

Such a conductive wire may be used by configuring the wire into a desired configuration, and applying energy to the covering to allow it to thermoplastically deform. The energy may be applied in the form of heat, such as with an oven or heat gun, or in the form of an electric current or chemical reaction.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

According to various aspects of the present invention, a new type of self-bonding conductive wire and a related method of using a self-bonding conductive wire is contemplated, which utilizes a self-bonding outer coating comprising a polyester polyether block copolymer. The wire includes a conductor and a self-bonding outer coating over the conductor, and is formed into the desired configuration of the user, such as in a bobbin-less coil or other self-supporting configuration. Subsequently, an energy source such as heat from an oven or heat gun is used to soften the polyester polyether block copolymer of the self-bonding outer coating. Consequently, the self-bonding outer coating associates with the self-bonding outer coating of adjacent strands of wire. The wire may then be removed from the energy source, allowing the self-bonding outer coating to harden, resulting in a bonded outer coating which attaches adjacent strands of wire to one another. It is additionally contemplated that the polyester-polyether block copolymer have a durometer hardness (Type D) measured according to ISO 686 of about 30, such as those which may be obtained commercially from polymer manufacturers such as E.I. DuPont de Nemours and Co. Inc. It is further contemplated that one or more layers of insulation may be disposed between the conductor and the self-bonding outer coating, and that the insulator may be an ethylene/tetraflouroethylene ("ETFE") copolymer.

Figure 1:
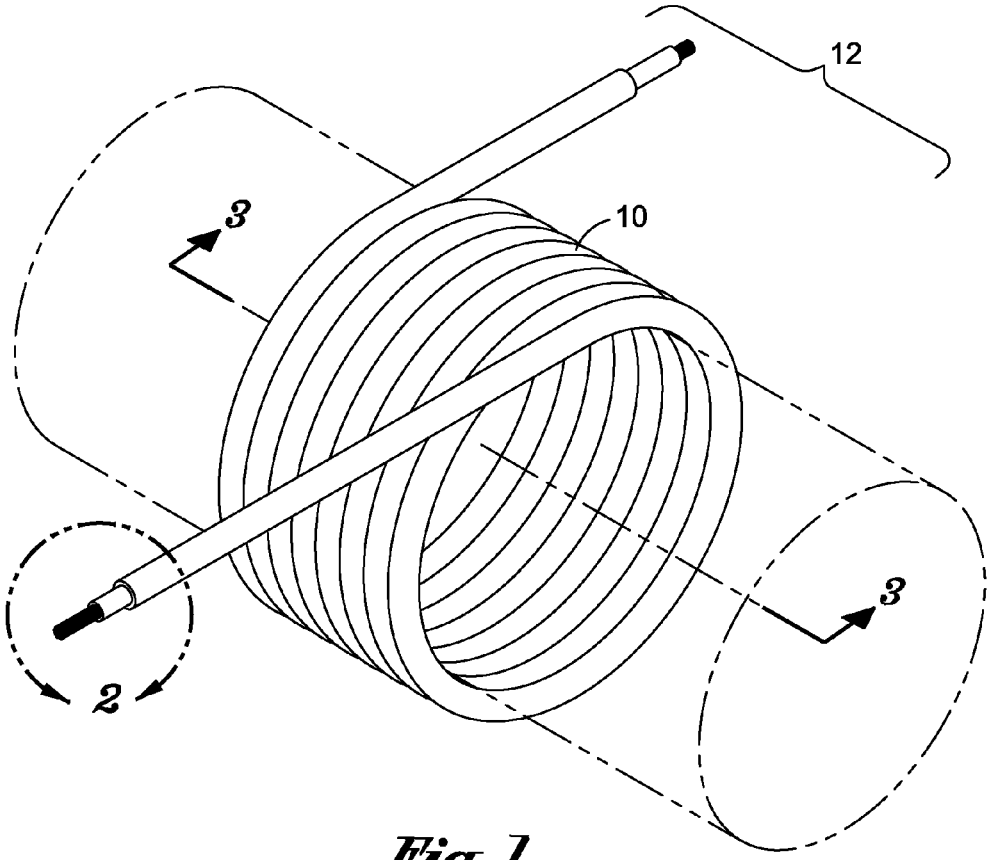
FIG. 1 is a perspective view of one embodiment of a self-bonding conductive wire.

Referring now to the drawings, and more particularly to FIG. 1, a self-bonding conductive wire 10 according to an exemplary embodiment of the present invention is shown. It may be seen that the self-bonding conductive wire 10 may be formed into a desired configuration by a user, such as a coil 12. However, it may also be seen that the self-bonding conductive wire 10 may be formed into many other configurations. The coil 12 of the exemplary embodiment of the self-bonding conductive wire 10 may find particular utility in certain application because it may not require a bobbin, and may be self-supporting, even when formed into coils of great size.

Figure 2:
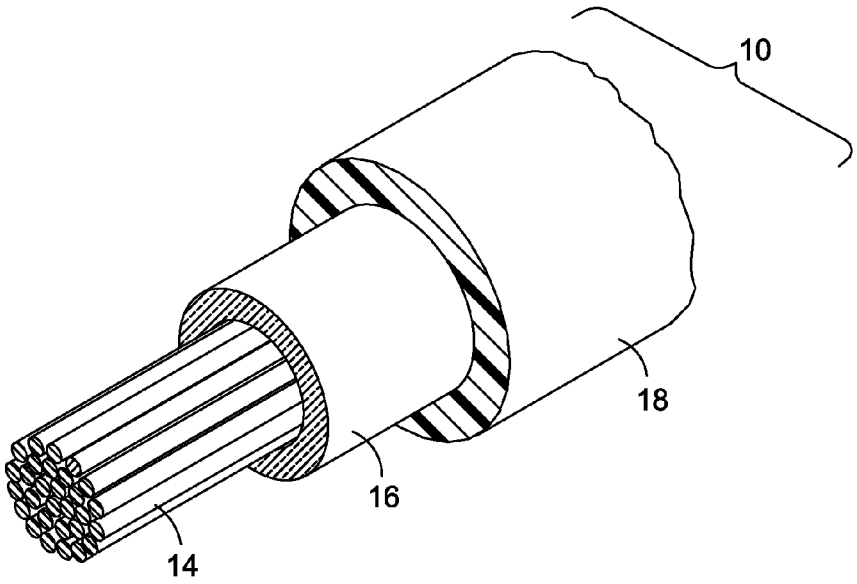
FIG. 2 is a detailed perspective cutaway view taken within circle 2 of FIG. 1, showing an individual strand of one embodiment of the self-bonding conductive wire.

Referring now to FIG. 2, a cutaway view of an individual strand of the self-bonding conductive wire 10 of the exemplary embodiment is shown. A self-bonding conductive wire 10 may have a conductor 14, an insulator 16 disposed over the conductor 14, and a self-bonding outer coating 18 disposed over the insulator 16 and the conductor 14.

The conductor 14 may be any conductive material usable in the making and using of conductive wire. For example, but without limitation, the conductor 14 may be a conductive metal such as copper, silver, or aluminum However, it may also be seen that the conductor 14 may not only be limited to electrically conductive materials, but may also include other signal conductors or transmitters, including but not limited to fiber optics, waveguides, or lasing mediums. Further, it may be seen that the conductor 14 may comprise a single wire of conductive material, or may also be a plurality of wires of conductive material as shown in the exemplary embodiment. Such a plurality of wires of conductive material may allow, for example, multiple signals to be conveyed over a single self-bonding conductive wire, or for greater flexibility, kink-resistance, and break-resistance in the self-bonding conductive wire 10.

The insulator 16 may be any insulative material useable in conductive wire. In the exemplary embodiment, the insulator 16 is a fluoropolymer, and more specifically, an ETFE copolymer. However, it may also be seen that the insulator 16 may be, for example but without limitation, other insulation materials known in the art and usable in conductive wire, such as silicon rubber or fiber reinforced plastic. The insulator 16 may comprise a single layer of insulative material, or multiple layers of insulative material. In the exemplary embodiment, a single layer of insulation is shown, but multiple layers of insulation comprising the same or different insulation material may also be used without departing from the scope of the present disclosure.

The self-bonding outer coating 18 may comprise a polyester polyether block copolymer. In the exemplary embodiment, the self-bonding outer coating 18 is a polyester polyether block copolymer having a durometer hardness (Type D) measured according to ISO 868 of about 30. Such a polyester polyether block copolymer may be synthesized by methods known in the art. For example, a polyester-polyether block copolymer may be synthesized with a narrow molecular weight distribution and chain length according to the methods described by Yasuda, Aida and Inoue in their article *Synthesis of Polyester-Polyether Block Copolymer with Controlled Chain Length from β-Lactone and Epoxide by Aluminum Porphyrin Catalyst*, published in *Macromolecules* 1984, 17, 2217-2222. The polyester polyether block copolymer may also be obtained commercially from companies such as E.I. DuPont de Nemours and Co. Inc., as sold under the trade name Hytrel®. The polyester polyether block copolymer of the exemplary embodiment in particular has a durometer hardness (Type D) measured according to ISO 868 of about 30, which corresponds to DuPont's Hytrel® 3078 commercial product.

Other qualities of the polyester polyether block copolymer used in the exemplary embodiment include the following:

| | |
|---|---|
| Flexural Modulus measured according to ISO 128 at −40° C. | 145 |
| Flexural Modulus measured according to ISO 128 at 28° C. | 28 |
| Flexural Modulus measured according to ISO 128 at 100° C. | 14 |
| Melting Point measured according to ISO 1346 | 170° C. |
| Vicat Softening Temperature measured according to ISO 306 (Rate B) | 83° C. |
| Specific Gravity | 1.07 |

However, it may be seen that the polyester polyether block copolymer used may vary in, for example but without limitation, molecular weight and chain length. Such variations may result in variations in the observable properties of the self-bonding outer coating 18 from those listed above, without departing from the scope of the present disclosure.

The use of a polyester polyether block copolymer to form the self-bonding outer coating 18, as in the exemplary embodiment, may have particular advantages, including a resistance to the degradation of material qualities pertinent to the structural integrity of the outer coatings of conductive wire. Such material properties may include melting point, modulus, tensile strength, and elasticity. It may be seen that in conventional self-bonding materials, or even in thermoplastic materials including random copolymers, thermoplastic softening may result in sharp reductions in these qualities following resolidification. The use of a polyester polyether block copolymer may, however, strongly mitigate these sharp reductions, as well as provide strong resistance to deterioration from many industrial chemicals, oils and solvents, and the necessary flexibility required in a wire application, due to the unique characteristics of the polyester polyether block copolymer.

Figure 3:
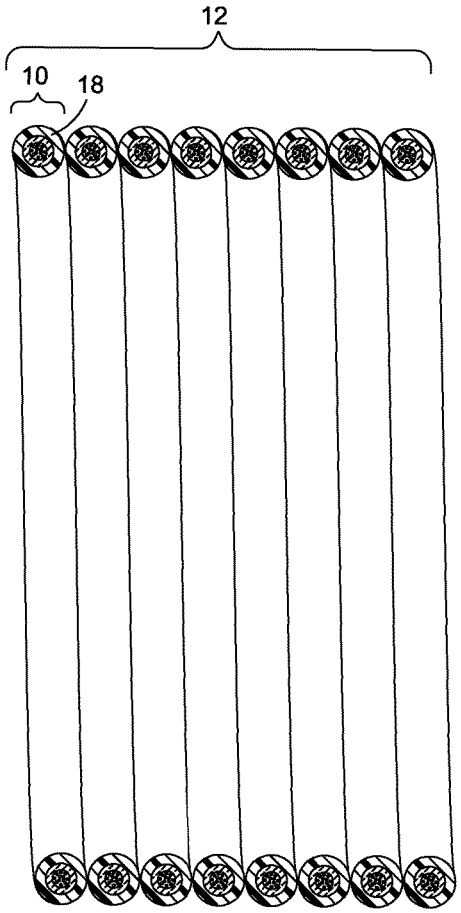
FIG. 3 is a cross-sectional view taken upon line 3 of FIG. 1, showing one embodiment of the self-bonding conductive wire.

Referring now to FIG. 3, the self-bonding conductive wire 10, when formed into a user's desired configuration, such as the coil 10 of the exemplary embodiment, may have a one or more individual strands of wire proximal to one another, with the self-bonding outer coatings 18 of the strands of wire preferably in physical contact with one another. Once the self-bonding conductive wire 10 has been configured into a desired configuration, such as the coil 12 of the exemplary embodiment, energy may be applied to the self-bonding outer coating 18, causing the polyester polyether block copolymer to thermoplastically deform and self-bond.

Such application of energy may include, for example, but without limitation, heat from a heat gun or oven, electricity, or chemical energy from a chemical reaction. However, it may be seen that any application of energy which may cause the polyester polyether block copolymer of the self-bonding outer coating 18 to thermoplastically deform and self-bond may be utilized. In one particular exemplary method, a user may place a formed coil 12 into an oven for a period of time suitable for the self-bonding outer coating 18 to self-bond. However, it may also be seen that in other configurations, it may be preferable to apply heat to only particular portions of the formed self-bonding conductive wire 10, such as those portions which are self-contacting. In those situations, a heat gun may be a preferred method of applying energy to the self-bonding outer coating 18.

Figure 4:
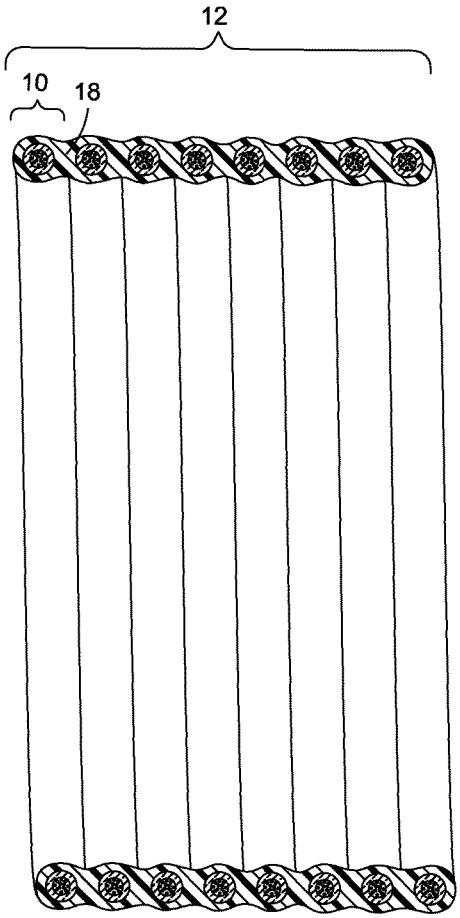
FIG. 4 is the same cross-sectional view of FIG. 3, shown after the wire of one embodiment of the self-bonding conductive wire has been self-bonded.

Referring now to FIG. 4, following the application of energy which may cause the self-bonding outer coating 18 to thermoplastically deform, the self-bonding outer coating 18 may then be allowed to resolidify. Thus, the individual strands of self-bonding conductive wire 10 may be, in such a fashion, fused into a contiguous structure having the same desired form as configured by the user prior to the application of energy to the self-bonding outer coating 18. For example, in the exemplary embodiment, the resulting bonded coil 12 of FIG. 4 has the same approximate shape of the unbounded coil 12 of FIG. 3, but the individual strands of self-bonding conductive wire 10 are no longer loose, but instead are retained by the resolidified and fused self-bonding outer coating 18. Such fusion may allow, for example, a configuration of self-bonding conductive wire 10 to be self-supporting, without requiring the use of extra added materials or equipment. Further, such fusion may mitigate the risk of individual strands becoming loose, noisy, or subject to early failure through vibrations and other movement.

With the structural features of the self-bonding conductive wire 10 described above, the following discussion concerns methods of making and using the self-bonding conductive wire 10 according to other aspects of the present invention. Such a self-bonding conductive wire 10 as described above may be made by any methods known in the art of making conductive wire. One of these methods may be, for example, passing a conductor 14 through a series of extrusion crossheads. The initial extrusion crosshead may, in one particular embodiment, coat the conductor 14 with a resinous insulator 16 such as a fluropolymer like ETFE. It may be seen that repeating the flowing of the conductor though the same or other extrusion crossheads may result in additional coatings of resinous materials, such as extra layers of insulation. The final extrusion crosshead may coat the conductor 14 and any materials disposed over the conductor by previous coatings, such as an insulator 16, with a self-bonding outer coating 18 comprising a polyester polyether block copolymer.

To use the self-bonding conductive wire 10 as described above, a user may first form the self-bonding conductive wire 10 into a desired configuration. Following this forming, the user may then apply energy sufficient to cause the polyester polyether block copolymer of the self-bonding outer coating 18 to thermoplastically deform. Such application of energy may be accomplished by, for example but without limitation, the application of heat through an oven or heat gun, or the application of electrical current or chemical energy. The user may then remove the energy source, and allow the self-bonded outer coating 18 to solidify, resulting in the fusion of the self-bonding outer coating 18 around strands of wire positioned proximally prior to the application of energy.

The above description is given by way of example, and not limitation. Given the above disclosure, one skilled in the art could devise variations that are within the scope and spirit of the invention disclosed herein, including various types of conductors 14, insulators 16, or methods of applying energy to the self-bonding outer coating 18. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A method of using a self-bonding conductive wire, comprising the steps of:

providing a wire comprising a conductor and a covering disposed over the conductor, the covering comprising a polyester polyether block copolymer;

configuring the wire into desired configuration wherein at least a first portion of the covering is placed in physical contact with at least a second portion of the covering;

applying sufficient energy to the first and second portions of the covering to cause the first and second portions of the covering to thermoplastically deform and self-bond with one another; and reducing the energy applied to the covering to cause the first and second portions of the covering to resolidify and fuse into a continuous structure.

2. The method of claim 1, wherein the durometer hardness (Type D) of the polyester polyether block copolymer measured according to ISO 868 is about 30.

3. The method of claim 1, wherein the providing step further comprising providing an insulator disposed between the conductor and the covering.

4. The method of claim 3, wherein the insulator comprises one or more layers of insulation disposed between the conductor and the covering.

5. The method of claim 4, wherein at least one of the one or more layers of insulation is a fluoropolymer.

6. The method of claim 5, wherein the fluoropolymer is an ethylene/tetrafluoroethelene copolymer.

7. The method of claim 1, wherein the applying step comprises applying energy to the covering in the form of heat.

8. The method of claim 1, wherein the applying step comprises applying energy to the covering in the form of electrical current.

9. The method of claim 1, wherein the applying step comprises applying energy to the covering in the form of chemical energy.

10. The method of claim 1, wherein the applying and reducing steps cause the wire to maintain the desired configuration.

* * * * *